US006675694B1

(12) United States Patent
Liebig

(10) Patent No.: US 6,675,694 B1
(45) Date of Patent: Jan. 13, 2004

(54) MACHINE GUN AND AMMUNITION CAN INTERFACE GUN MOUNT

(75) Inventor: Michael T. Liebig, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/337,320

(22) Filed: Jan. 7, 2003

(51) Int. Cl.[7] ..... F41A 23/12

(52) U.S. Cl. ..... 89/40.08; 89/37.03; 89/40.03; 89/40.06

(58) Field of Search ..... 89/40.06, 40.08, 89/37.03, 37.04, 37.14, 37.02, 37.16, 37.17, 37.21, 40.03

(56) References Cited

U.S. PATENT DOCUMENTS

| | | | | |
|---|---|---|---|---|
| 1,155,061 A | | 9/1915 | Heinemann | |
| 1,273,178 A | | 7/1918 | Perry et al. | |
| 2,014,376 A | * | 9/1935 | Coupland | |
| 2,334,152 A | * | 11/1943 | Trotter | |
| 5,194,678 A | | 3/1993 | Kramer | 42/94 |
| 5,711,103 A | | 1/1998 | Keng | 42/94 |

FOREIGN PATENT DOCUMENTS

| | | | | |
|---|---|---|---|---|
| GB | 8969 | * | 3/1919 | 89/40.06 |
| GB | 249924 | * | 4/1926 | 89/40.06 |

OTHER PUBLICATIONS

War Department; TM 9–224; Machine Gun Mounts For Trucks; pp. 1–48; Apr. 22, 1943.*

* cited by examiner

*Primary Examiner*—Stephen M. Johnson
(74) *Attorney, Agent, or Firm*—Mark Homer

(57) ABSTRACT

A gun mount for use with weapons that do not have a forward mount point or a mid weapon mount orientation is required. The gun mount is securely attached to the weapon by using two existing separate structural features of the gun as attach points. The first point of attachment is the ammunition can mounting bracket and the second attachment point is the main mounting lug located proximate the trigger guard. Once attached to the gun, the mount can be attached via a main coupling to an existing tripod or vehicle mount. The two-point attachment allows the shooter to steady the gun and eliminate vibration and improve accuracy of aim. In addition, the ammunition can is relocated from the common position underneath the gun to a vertical position on the left side of the gun for better alignment and ammunition feed. The entire assembly is formed of coated aluminum to effect a strong, compact and lightweight design.

9 Claims, 9 Drawing Sheets

MACHINE GUN AND AMMUNITION CAN INTERFACE GUN MOUNT

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention relates to interface gun mounts and, more particularly, to a lightweight machine gun and ammunition can mount for use with weapons that do not have a forward mount point or a mid weapon mount orientation is required.

2. Description of the Background

The size and weight of many firearms, particularly large guns, such as machine guns, precludes accuracy and stability without some type of support or mounting apparatus to hold the weapon steady while being fired. Thus, mounting devices and other support apparatus have long been used with large guns to stabilize the gun and reduce vibration, thereby improving accuracy and alleviating fatigue and discomfort of the shooter. Indeed, when mounting devices and other support apparatus have not been available a shooter has often needed to rely on any immovable object available, such as walls, rocks, tree trunks, etc.

A variety of interface elements have evolved for use in mounting rifles or light machine guns. For example, U.S. Pat. No. 1,273,178 to Heinemann shows an apparatus designed for attachment to a hand machine gun to counteract its tendency to jump/recoil during firing. The apparatus is acted upon in a downward direction by the gases leaving the muzzle, thereby creating a downward force at the forward end of the gun's barrel. The apparatus also includes a 10 pair of downward extending eyelets for optional attachment to a gun rest or mount.

U.S. Pat. No. 1,273,178 to Perry et al. discloses an apparatus utilized to mount a rapid fire gun on a motorcycle. The mounting apparatus allows a single individual to both drive the motorcycle and fire the gun. The mounting of the gun is such that it may be easily operated and adjusted without the rider leaving the seat of the motorcycle. The apparatus includes a circular clamping attachment to fixedly attach the gun to the position adjustment mechanism.

U.S. Pat. No. 5,194,678 to Kramer discloses a rest for the firearm or the like that attaches to the sling on the forearm of the firearm. The firearm rest is comprised of two major assemblies. The first assembly attaches to the sling swivel and provides a surrogate sling swivel and a female receptacle for the second assembly. The second assembly consists of a male protrusion that mates with the first assembly and two lightweight legs that can be quickly assembled and disassembled.

U.S. Pat. No. 5,711,103 to Keng discloses a bipod mounting assembly for attaching a bipod to the forearm stock portion of a firearm. The apparatus includes a mounting yoke adapted to quickly and easily attach to the swivel stud connector mounted to the forearm stock portion of the firearm. The mounting yoke is adapted to receive a mounting block thereover, with the mounting block being attached to the mounting yoke to thus attach the mounting block to the forearm stock portion of the firearm. A bipod-mounting frame is releasably attachable to the mounting block by a quick-release locking catch to enable the quick attachment/detachment of the legs of the bipod from the mounting block, and thus the firearm.

Although each of the prior art examples provides an interface for use in mounting firearms which uses the pre-existing structure of the gun, they do not accommodate weapons that have no forward attach point and which are not designed for mounting.

Consequently, there is a significant need for a lightweight machine gun and ammunition can gun mount for use with weapons that do not have a forward mount point or a mid weapon mount orientation is required, such as the MK46 and M249SPW weapons.

FIG. I is a drawing of an existing MK46 machine gun which illustrates the location of the ammunition can which is attached to an existing ammunition can mount bracket of the weapon, and a supplied forearm rail system. In addition, the weapon includes a main mounting lug located proximate to the trigger guard (obscured) for a single-point mount. Otherwise, no provision for vehicle or tripod mounting is provided.

The design challenge with such guns is to determine how to securely attach a vehicle or tripod mount to the weapon to allow easy firing without impacting the performance of the gun.

SUMMARY OF THE INVENTION

It is, therefore, the object of the present invention to provide a machine gun and ammunition can interface gun mount for use with weapons that do not have a forward mount point or a mid weapon mount orientation is required.

It is yet another object to provide a machine gun and ammunition can interface gun mount with two point secure attachment to allow easy firing without impacting the performance of the gun.

It is another object to provide a machine gun and ammunition can interface gun mount that is small, lightweight and economical to produce.

It is still another object to provide a machine gun and ammunition can interface gun mount with two point attachment for improved stability and anti-rotation, the first point being the ammunition can mount attached to the weapon for anti-rotation and the second point being directly in front of the trigger mechanism.

It is yet another object to provide a machine gun and ammunition can interface gun mount in which the ammunition can is repositioned to the left side of the gun for better alignment and ammunition feed.

According to the present invention, the above-described and other objects are accomplished by a gun mount that is securely attached to the weapon by using two existing separate structural features of the gun as attach points. The first point of attachment is the ammunition can mounting bracket and the second attachment point is the main mounting lug located proximate the trigger guard. The two point attachment allows the shooter to steady the gun and eliminate vibration and improve accuracy of aim. The ammunition can is relocated from the common position underneath the gun to a vertical position on the left side of the gun for better alignment and ammunition feed. Both the ammunition can interface and main mounting lug interface are formed of coated aluminum to effect a strong, compact and lightweight design. Thus, the present invention is small, compact, lightweight, and economical to manufacture.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
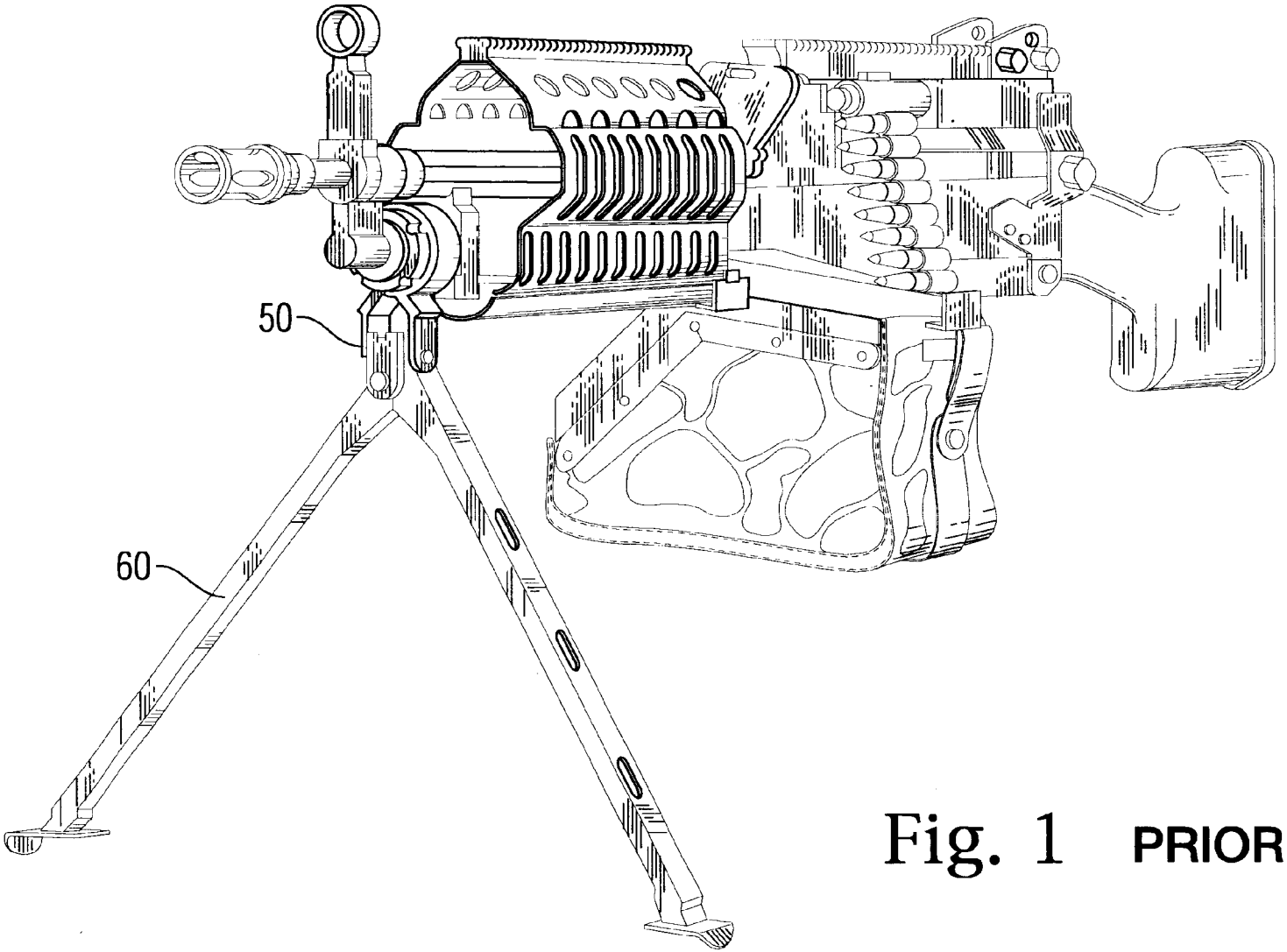
Fig. 1 PRIOR ART
FIG. 1 is a perspective drawing of a prior art MK46 machine gun.

The present invention is designed to attach to the bottom of the weapon such as shown in FIG. 1, but at two separate attach points for improved stability.

Figure 2:
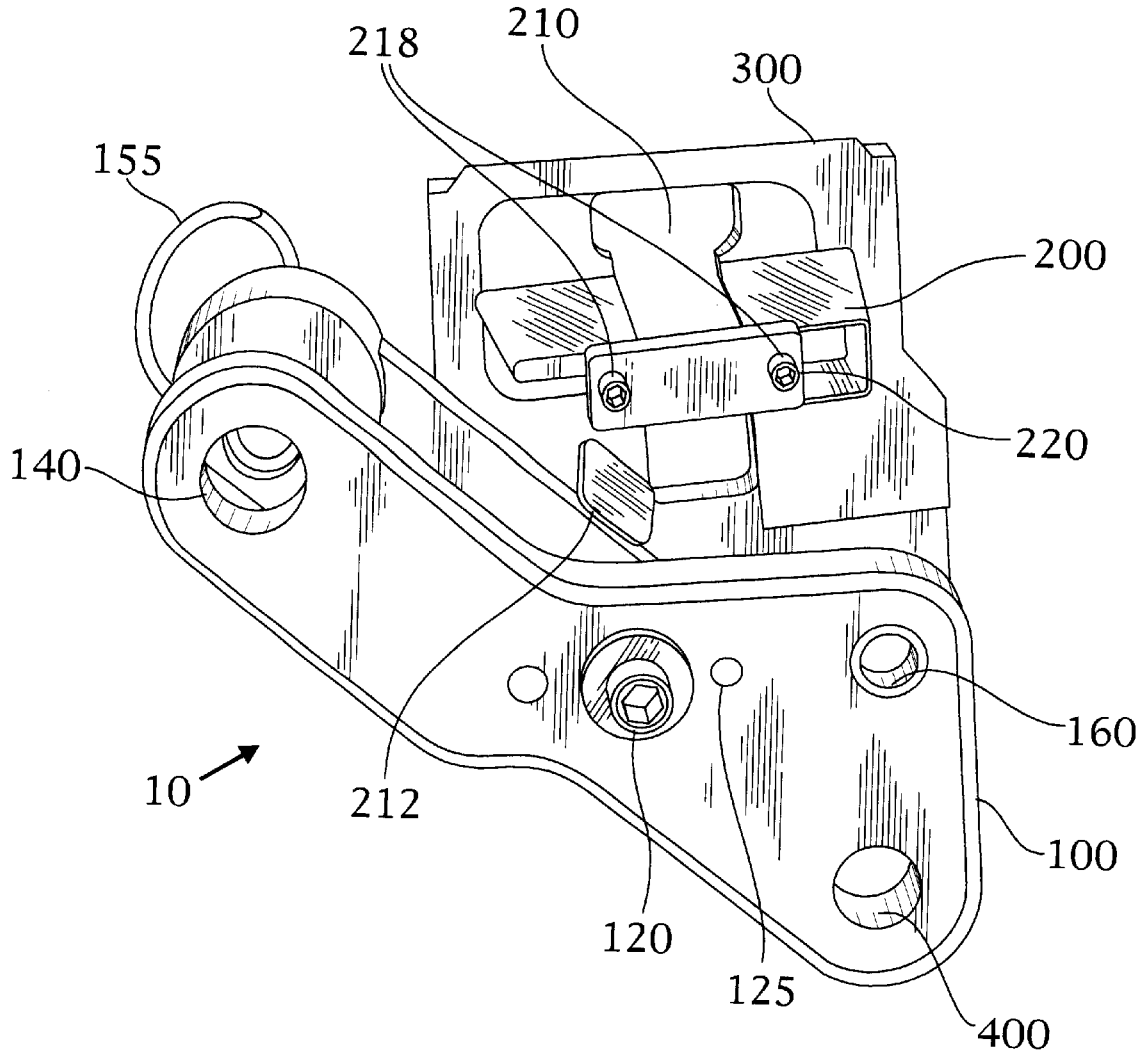
FIG. 2 is a right side perspective view of the machine gun and ammunition can interface gun mount assembly according to the present invention showing the ammunition can mount interface pivoted inward.

FIG. 2 is a right side perspective view of the machine gun mount assembly 10 according to the present invention (from the weapon side). The machine gun mount assembly 10 generally comprises a trigger guard interface 100 pivotally attached to an ammunition can mount interface 200 and fixedly attached to an ammunition can holder 300 by bolt 120 and two alignment pins 125. A main coupling 400 is distally spaced from the trigger guard interface hole 140 and section 130 to allow mounting of the weapon and gun mount assembly 10 to a pintle 50 (see FIG. 1) for placement in an existing tripod or vehicle mount 60 (see FIG. 1).

Figure 3:
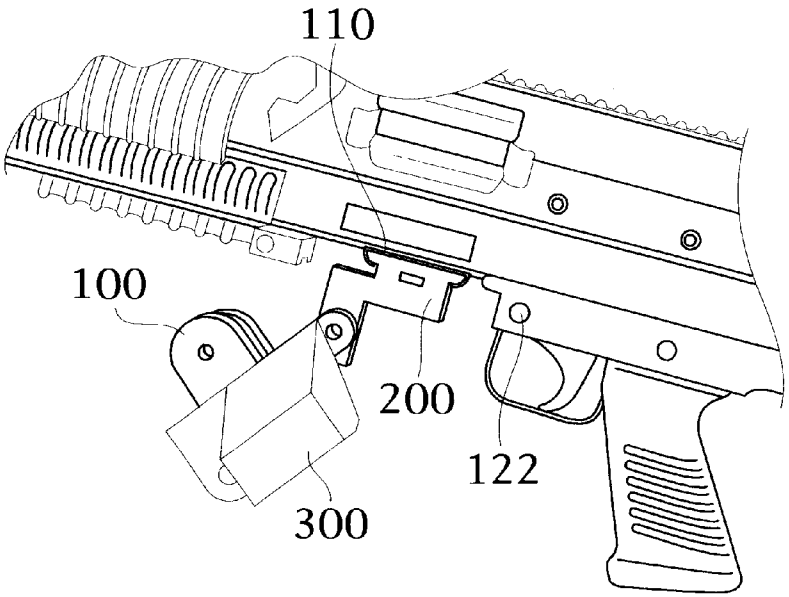
FIG. 3 is a perspective view illustrating how to attach the gun mount assembly 10.

To attach the machine gun mount assembly 10 as shown in FIG. 3, the ammunition can is first removed from the ammunition can mount bracket 110 of the weapon, and the ammunition can mount interface 200 of the gun mount assembly 10 is slidably fitted into the vacant ammunition can mount bracket 110 and latched in place. The trigger guard interface 100 of the gun mount assembly 10 is pivoted back and is attached by pin 150 to the main mounting lug 122 on the weapon (proximate the trigger guard).

Figure 4:
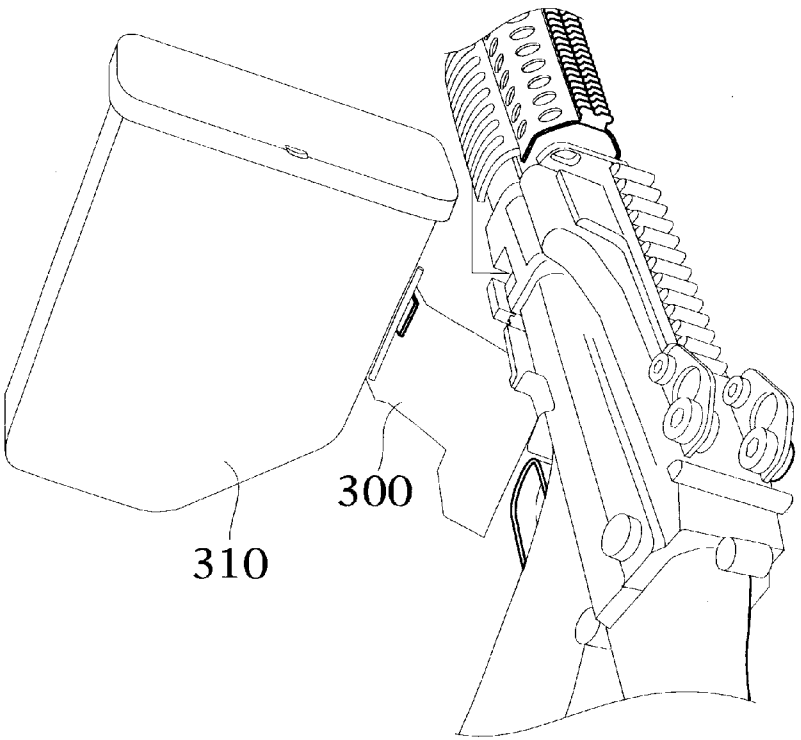
FIG. 4 is a perspective view illustrating how to attach the ammunition can to the gun mount assembly 10.

Next, as shown in FIG. 4, the ammunition 310 can is reattached to the ammunition can holder 300 which protrudes outward from the left side of the machine gun mount assembly 10 (shown in FIG. 2). This positions the ammunition can vertically, which provides better alignment and ammunition feed than the common horizontal position.

In FIG. 2, the ammunition can mount interface 200 is pivoted inward. However, the ammunition can mount interface 200 pivots outward (see FIG. 5) into position to attach to the ammunition can mount bracket 110 of the weapon by a spring-mounted latch 210 seated in a dovetail flange 233.

The ammunition can (not shown) is then attached to the ammunition can holder 300 on the outward-facing side of the mount assembly in FIG. 2, and this positions the ammunition can vertically, which provides better alignment and ammunition feed than the common horizontal position.

A more detailed explanation of the attachment mechanisms follows.

Figure 5:
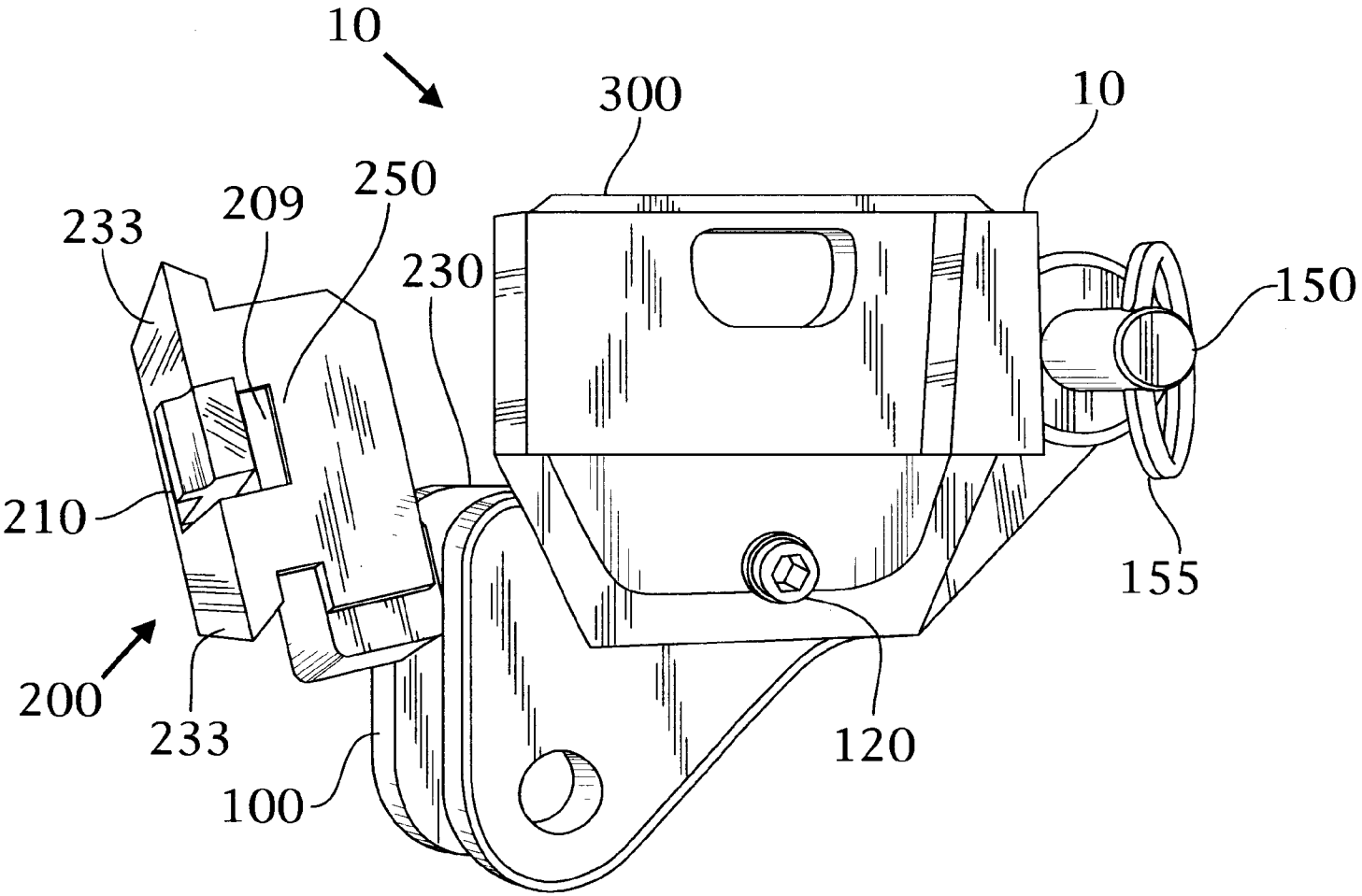
FIG. 5 is the opposite side (left) perspective view of the machine gun and ammunition can interface gun mount assembly showing the ammunition can mount interface pivoted outward.

FIG. 5 is an opposing (left) perspective view of the machine gun mount assembly 10 showing the ammunition can holder 300 and the ammunition can mount interface 200 pivoted outward. With combined reference to FIGS. 2 and 5, the latch 210 is secured in place by a mount latch retainer 220 that is fixedly attached by bolts to the ammunition can mount interface assembly 200. The distal end of the pivot pin 230 projects through the pivot holes to establish a pivoting connection between the trigger guard interface 100 and the ammunition can mount interface 200. The flange 233 is formed in a dovetail configuration separated by a groove 250 in which the latch 210 is seated on a spring 209. The resulting spring-latch connection locks the latch 210 into place when the interface 200 slides fully into the ammunition can mount bracket of the weapon. This is a spring loaded releasably latch connection.

Figure 6:
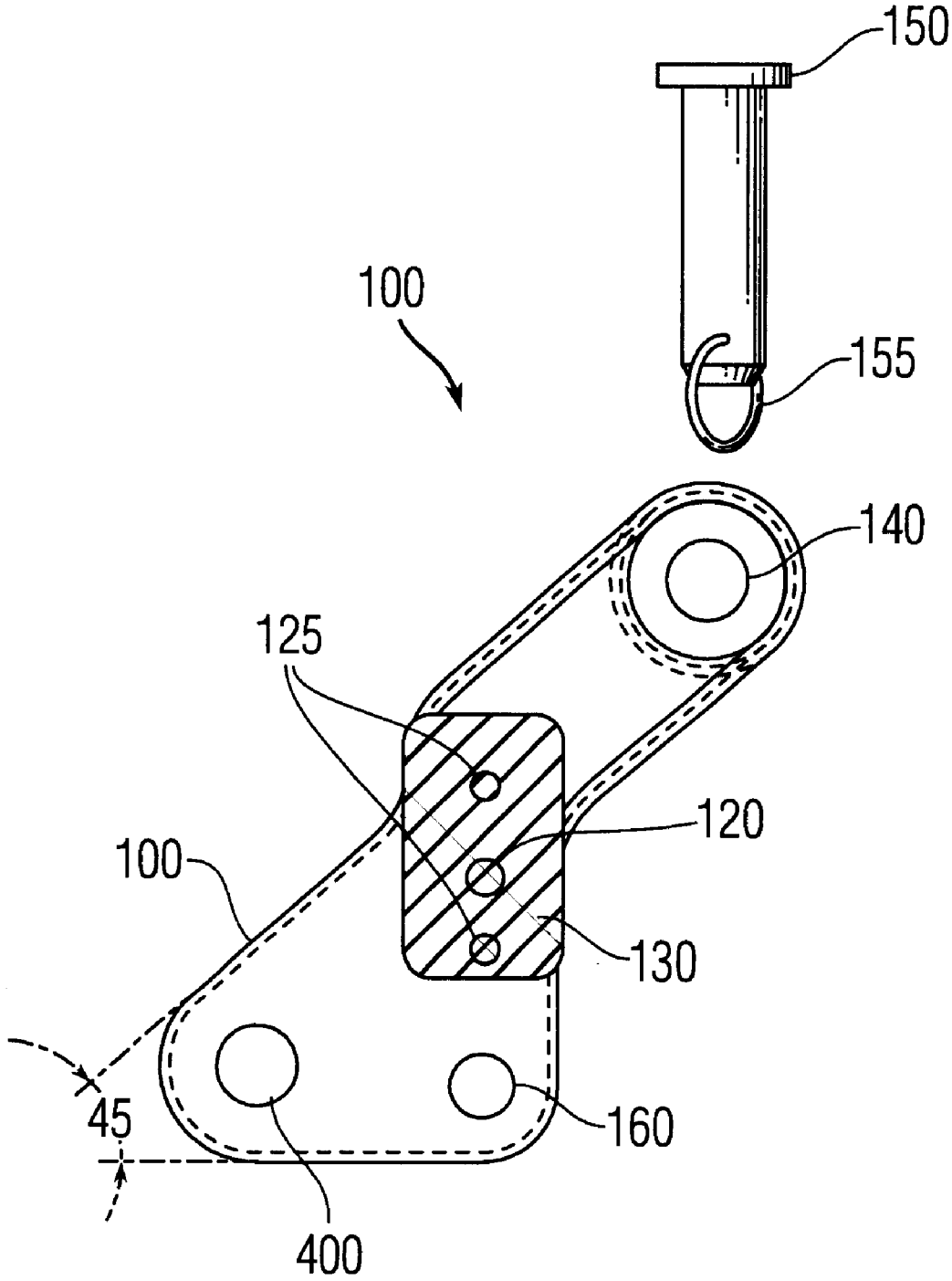
FIG. 6 is a side perspective view of the trigger guard interface component of the machine gun mount assembly 10.

FIG. 6 is a side view of the trigger guard interface component 100 of the machine gun mount assembly 10. The trigger guard interface component 100 is fixedly attached to the main mounting lug 122 of the weapon by means of pin 150, which is inserted into the pin hole 140 that extends through the trigger guard interface 100 and through the main mounting lug 122 located just in front of the trigger guard of the weapon. The ammunition can mount interface 200 (not shown in FIG. 6) is fixedly attached to the trigger guard interface 100 by bolt 120 and two alignment pins 125 that align the connection between the two components. A pivot pin (not shown) is inserted into the pivot hole 160 to create the pivot mechanism that pivots the assembly outward for connection to the ammunition can mount of the weapon.

Figure 7:
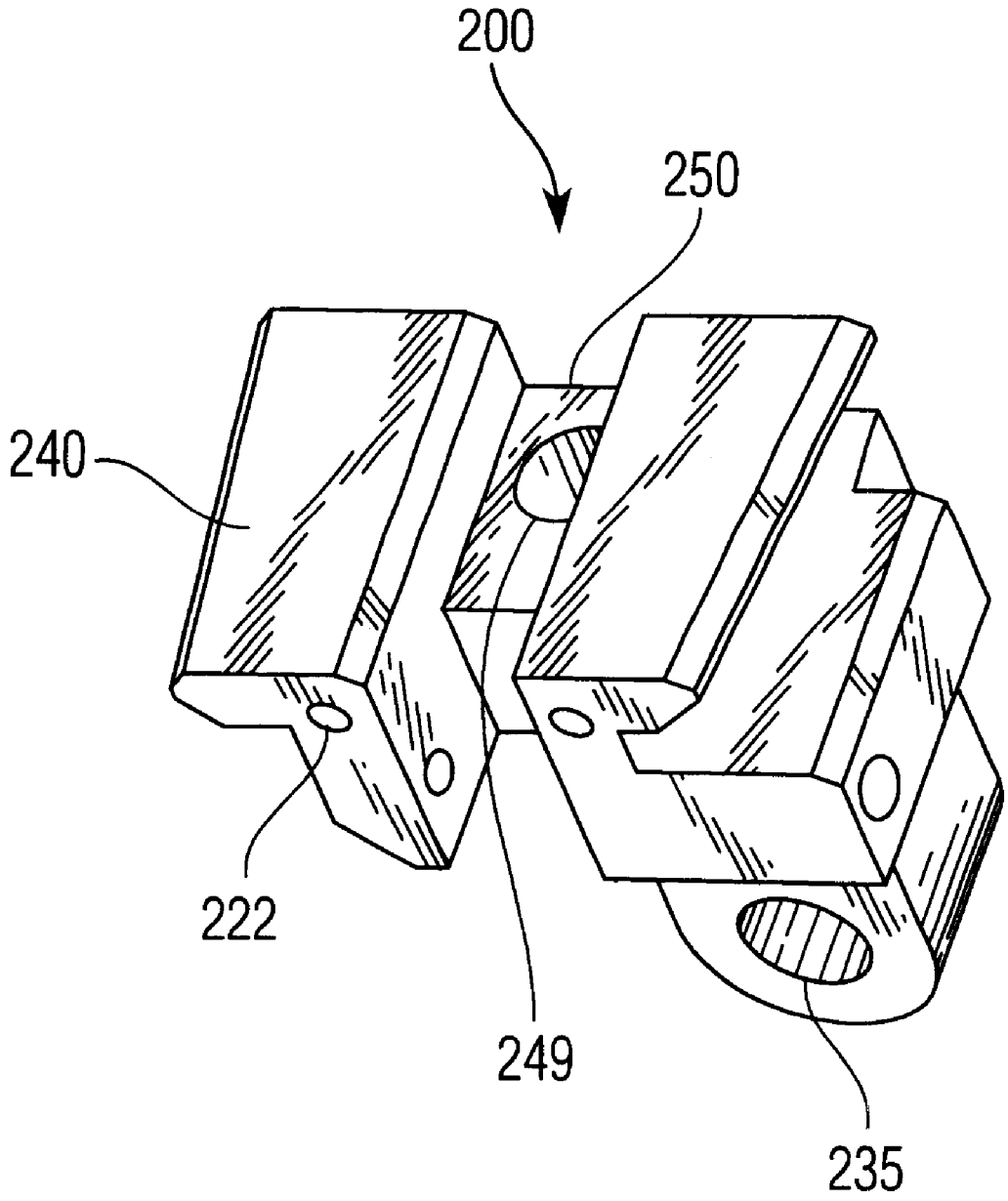
FIG. 7 is a side perspective view of the ammunition can mount interface component of the machine gun and ammunition can interface gun mount assembly.

FIG. 7 is a side perspective view of the ammunition can mount interface component 200 of gun mount assembly 10. The pivot slot 235 receives the pivot pin (not shown) that allows the assembly to pivot outward to accomplish the two-point attachment to the weapon. The dovetail configuration of the flange 233 defines a flat top surface 240 which conforms to the ammunition can mount of the weapon and allows it to slide into and remain in an attached position. Spring 209 is loaded into a spring bore hole 249 located in the groove 250 between the two wings of the flange 233. The latch 210 fits in groove 250 atop spring 209 to provide the spring and latch. The spring 209 biases latch 210 upward locking the interface 200 in place when the top surface 240 is slidably attached to the ammunition can mount bracket of the weapon. However, by exerting force to the external portion of the latch 210, the distal end of the latch 210 becomes disengaged and the interface 200 can be slidably removed. As best seen in FIG. 2, a rectangular latch retainer 220 is attached to interface 200 by bolts 218 inserted through bolt holes 219 in either side of latch retainer 220 to fixedly secure the spring latch 210 in place.

Figure 8:
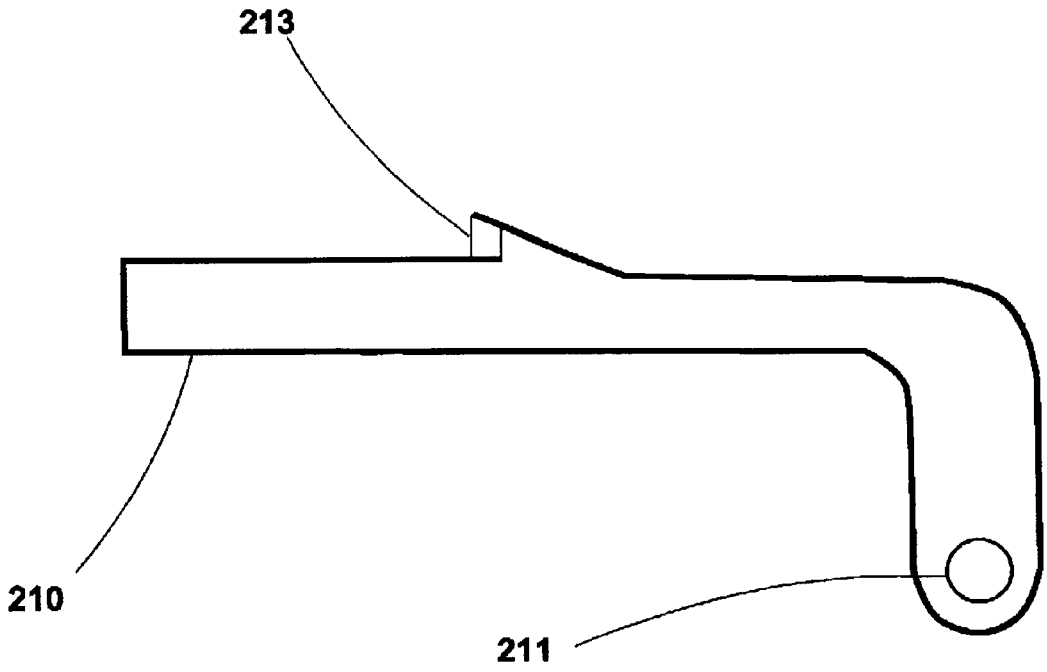
FIG. 8 is a close-up perspective view of the weapons mount latch of the ammunition can mount interface of FIG. 7.

FIG. 8 is a close up side perspective view of the weapons mount latch 210 of the ammunition can mount interface 200 of FIG. 7. The latch 210 is pivotally attached to the ammunition can mount interface 200 by a latch pivot pin 212 inserted into the pivot pin hole 211. The pivot pin 212 straddles the two wings of the flange 233 to keep the latch 210 seated therein, and thereby allowing the latch 210 to pivot outward. The latch includes a raised lip 213 that protrudes upward at an angle, thereby allowing the flange 233 and latch 210 to slide into the ammunition can mount bracket of the weapon. When the flange 233 is fully inserted the lip 213 clears the ammunition can mount bracket of the weapon and spring 209 biases the latch upward, thereby locking the latch 210 in place.

Figure 10:
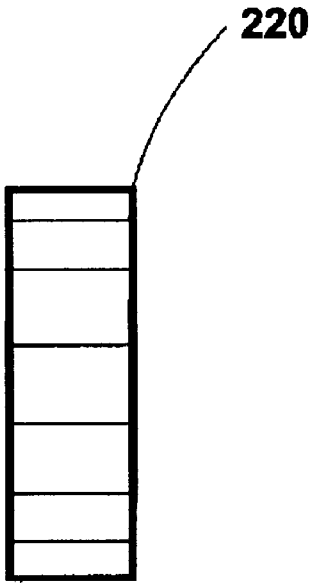
FIGS. 9 and 10 are close-up front and side perspective views, respectively, of the mount latch retainer 220 as seen in FIG. 2.
Figure 9:
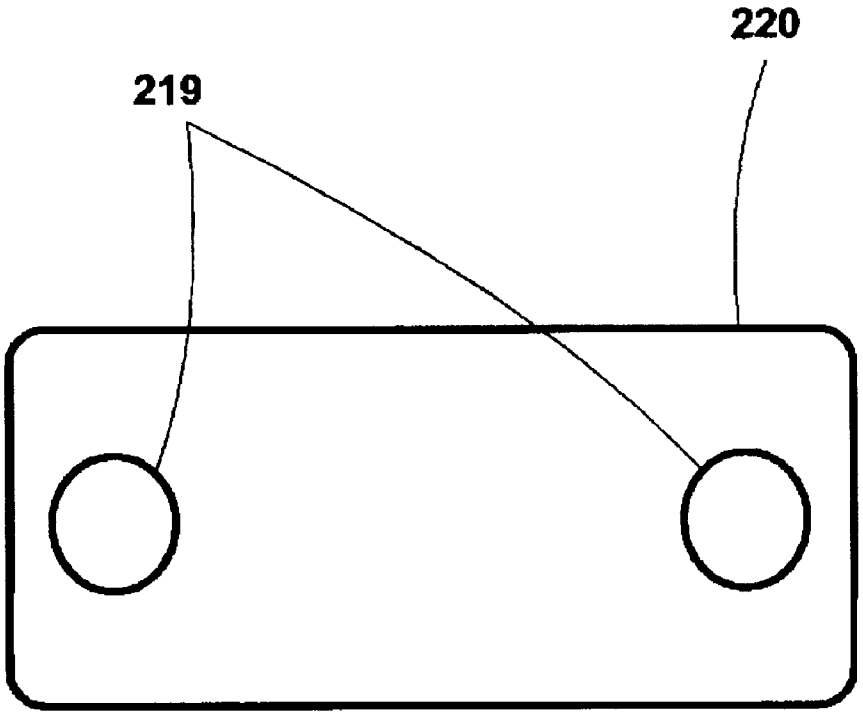

FIGS. 9 and 10 are close-up front and side perspective views, respectively, of the mount latch retainer 220 as seen in FIG. 2. A bolt inserted in bolt holes 219 at each end of the retainer 220 fixedly attaches the latch 210 to the interface 200 and secures the latch from pivoting too far outward.

Figure 11:
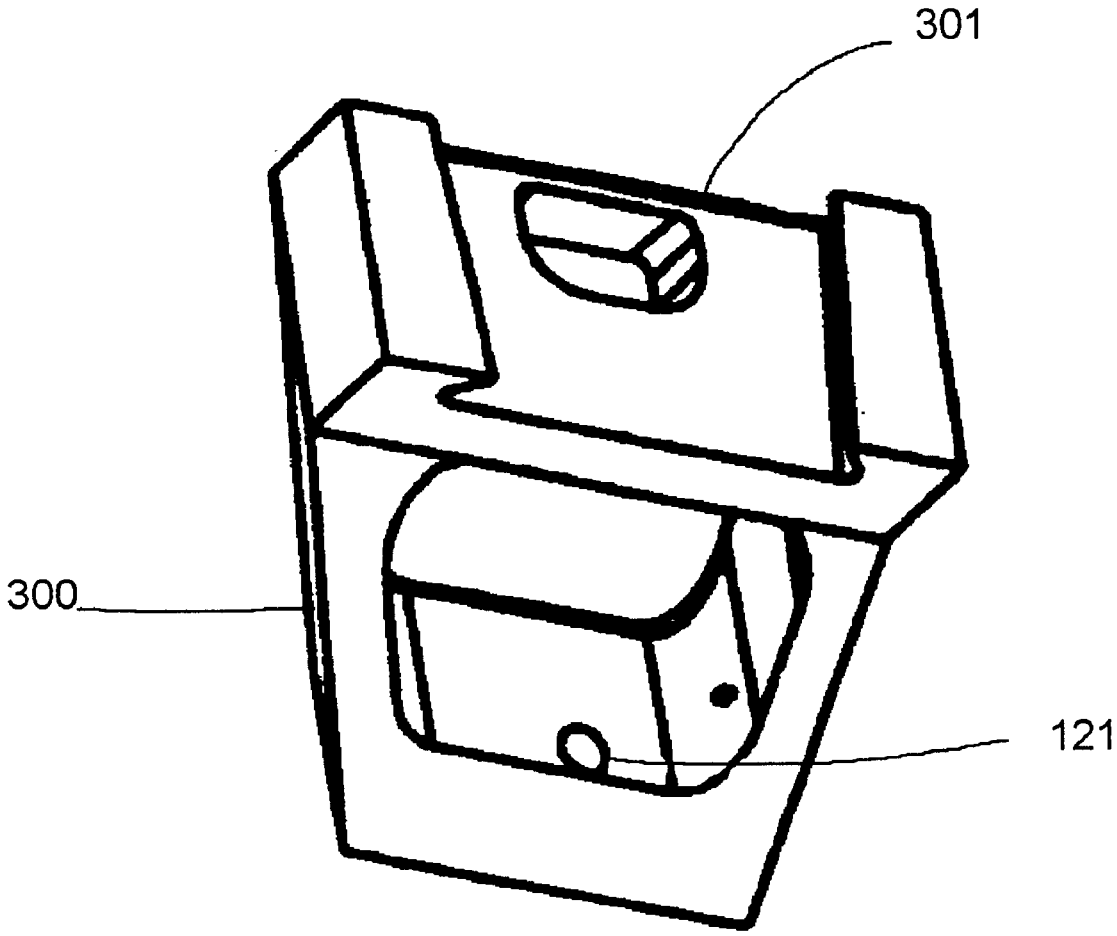
FIG. 11 is a bottom left perspective view of the mount ammunition can holder component of the machine gun and ammunition can interface gun mount assembly.

FIG. 11 is a bottom perspective view of the ammunition can holder component 300 of the machine gun mount assembly 10. Bolt 120 (as seen in FIG. 2) is inserted through bolt hole 121 in the ammunition can holder 300 and the trigger guard interface 10 to fixedly connect the two assemblies. The ammunition can holder component 300 includes a tongue-and-groove bracket 301 that mirrors that on the weapon itself to slidably connect the ammunition can and hold the can in place while firing.

The above-described machine gun mount assembly 10 according to the present invention improves stability in firing, allows the gun to be easily fired without impacting the performance of the gun and improves the feed of ammunition to the gun. The assembly is small, compact, lightweight, and economical to manufacture.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims

I claim:

1. An interface for mounting an existing machine gun to a tripod, vehicle or other mount, said machine gun having a main mounting lug and an ammunition can mount interface bracket, the interface comprising:

a trigger guard interface for attachment to the main mounting lug of said machine gun;

an ammunition can mount interface for attachment to the ammunition can mount interface bracket of said machine gun;

an ammunition can holder fixedly attached to said ammunition can mount interface; and a main coupling spaced from the trigger guard interface to allow mounting of the machine gun to a pintle for installation to the existing tripod, vehicle or other mount.

2. The interface according to claim 1, wherein said trigger guard interface includes a pin and corresponding pin hole for fixedly attaching said interface to the main mounting lug of said machine gun.

3. The interface according to claim 1, wherein said ammunition can mount interface includes a pivot hole and pin for pivotally connecting said interface to the ammunition can mount interface bracket.

4. The interface according to claim 1, wherein said ammunition can mount interface includes a dovetail flange with spring latch for engaging the ammunition can mount interface bracket of said machine gun.

5. The interface according to claim 1, wherein said ammunition can holder includes a tongue-and-groove receptacle for slidably attaching said ammunition can.

6. The interface according to claim 1, wherein said ammunition can mount interface further comprises means for locking said ammunition can mount interface to the ammunition can mount interface bracket of said machine gun.

7. The interface according to claim 6, wherein said locking means further comprises a spring-loaded latch that engages and disengages the ammunition can mount interface bracket of said machine gun.

8. The interface according to claim 7, wherein said latch is pivotally attached to said ammunition can mount interface.

9. The interface according to claim 8, wherein said ammunition can mount interface further comprises a rigid latch retainer for securing said latch from excess pivoting.

* * * * *